US006668814B1

(12) United States Patent
Borrell

(10) Patent No.: US 6,668,814 B1
(45) Date of Patent: Dec. 30, 2003

(54) MECHANISM FOR DEPLOYING CYLINDRICAL OBJECTS FROM A SPINNING CONTAINER

(75) Inventor: Frederick J. Borrell, La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/216,466

(22) Filed: Aug. 12, 2002

(51) Int. Cl.[7] ..... F41B 3/04
(52) U.S. Cl. ..... 124/6
(58) Field of Search ..... 124/4, 6

(56) References Cited

U.S. PATENT DOCUMENTS

| | | | | |
|---|---|---|---|---|
| 3,613,655 A | 10/1971 | Tobin et al. | ..... | 124/6 |
| 3,989,206 A | 11/1976 | Gregory | ..... | 244/63 |
| 4,463,745 A | 8/1984 | Acker | ..... | 124/6 |
| 4,632,086 A | 12/1986 | Rutten | ..... | 124/6 |
| 4,705,014 A | 11/1987 | Kahelin | ..... | 124/1 |
| 4,884,508 A | 12/1989 | Kruse et al. | ..... | 102/524 |
| 5,042,389 A | 8/1991 | Sabranski et al. | ..... | 102/489 |
| 5,052,305 A | 10/1991 | Chiarelli et al. | ..... | 102/522 |
| 5,642,723 A | 7/1997 | Hogan | ..... | 124/22 |
| 5,671,722 A | 9/1997 | Moody | ..... | 124/22 |
| 5,909,003 A | 6/1999 | Burri | ..... | 102/518 |

*Primary Examiner*—John A. Ricci
(74) *Attorney, Agent, or Firm*—Mark Homer

(57) ABSTRACT

A mechanism for deploying cylindrical objects from a spinning container includes a dispenser that uses rotation around the axis of symmetry of the dispenser to eject several cylindrical objects in any of many regular, predictable patterns. The dispenser rigidly holds the cylinders within a carrier vehicle as the vehicle accelerates to high velocity. The dispenser is spinning about the axis of the dispenser at a high rate. Then on signal, the dispenser releases all of the cylinders simultaneously. Each one of the cylinders leaves the vehicle with the cylinder's axis parallel to that of the dispenser and at each cylinder's own tangential velocity.

31 Claims, 14 Drawing Sheets

MECHANISM FOR DEPLOYING CYLINDRICAL OBJECTS FROM A SPINNING CONTAINER

BACKGROUND OF THE INVENTION

1. Field of the Invention

The present invention relates to an object dispenser, and more particularly, to a dispenser that uses rotation around the dispenser's axis of symmetry to eject cylindrical objects in any of several precise, predetermined patterns.

2. Description of the Background Art

An assortment of object dispensing devices have been used. Present devices that use rotation to eject objects, have been limited to sometimes only one object at a time. Even with one object, there has been a lack of control of the direction and speed. Some existing methods hold objects within a band or sleeve, then release the objects by breaking or sliding the band or sleeve from the objects. The bands and sleeves bunch the objects together, and do not positively control their orientation relative to one another or their container. Techniques used to break or remove the bands or sleeves produce random forces that cause the objects to leave the container in unpredictable ways, including random tumbling and chaotic trajectories that cause collisions between objects being released.

Another type of object dispensers had barriers that prevented emission of the projectile at the precise moment that it achieves its maximum speed. Complicated deploying mechanism have caused much problems in reliability and precision in releasing the objects from the dispenser.

An exemplar of the art is U.S. Pat. No. 4,632,086 issued to Rutten for A Rotor for Centrifugal Launching Devices. The device is designed to launch oblong shaped objects similar to conventional shells. A rotor with a cylindrical gun is rotated around an axis. The gun is located across the radius of the rotor. U.S. Pat. No. 3,613,655 issued to Tobin et al. for A Centrifugal Gun discloses a centrifugal gun that releases projectiles at very high velocities. The gun has a rotatable impeller with a center of rotation. The device fires a projectile by a track-controlled radial and tangential accelerations utilizing centrifugal force. U.S. Pat. No. 4,463,745 issued to Acker for A Device for Launching A Projectile discloses a device that has a rotatably driven carrier that has one or more guide tubes radially arranged. The feeding path for the projectiles are located near the rotational axis. U.S. Pat. No. 4,705,014 issued to Kahelin for A Variable Speed Single-Wheeled Ball Propelling Machine discloses a ball guided along the wheel until it is released tangentially along the circumference of the wheel. U.S. Pat. No. 4,884,508 issued to Kruse, et al. for A Spin Stabilized Carrier Projectile Equipped with A Driving Band discloses a carrier projectile that distributes the connection of the driving band and projectile object body so as to impart a spinning force. The rifling of the gun barrel causes the driving band to spin which in turn causes the projectile base to spin. The projectile body is then forced to spin by the force transmitted from the projectile base. U.S. Pat. No. 5,671,722 issued to Moody for A Projectile Launcher discloses a projectile launcher that has a barrel for supporting a projectile before and during the launch. The device uses a pulley system for stretching a rubber like material. The force created by the stretched rubber material accelerates the projectile. U.S. Pat. No. 5,642,723 issued to Hogan for An Elastic Band Slinger discloses an elastic band slinger that has an elongated base with an elongated guide track. An arrow shape projectile is positionable along the guide track for launching. The force of the band propels the projectile. U.S. Pat. No. 5,909,003 issued to Burri for A Projectile Rotating Band discloses a band that is secured to the projectile base. The rotating bands guide the projectile inside the barrel when it is discharged to cause a rotating motion around the longitudinal axis of the projectile. U.S. Pat. No. 3,989,206 issued to Gregory for A Rotating Launch Device for A Remotely Piloted Aircraft discloses an aircraft that is rotated around a circular path about a fixed pivot point until a predetermined speed is reached. The aircraft and a counterweight on the rotating arm are both released at the same time. The aircraft is forced in path tangent to the circular path at the point of release. U.S. Pat. No. 5,052,305 issued to Chiarelli et al. for A Subcaliber Projectile Including A Core, A Sabot And A Sleeve discloses a projectile that has a sleeve that separates into several sectors under the effect of centrifugal force. U.S. Pat. No. 5,042,389 issued to Sabranski et al. for A Carrier Projectile discloses a large caliber carrier projectile that has an ejector plate that separates into at least two separable parts because of the centrifugal force after ejection from the carrier projectile. The multiple segments of the ejector plate are held together by a vulcanization layer formed of materials like rubber. The centrifugal force breaks the ejector plate into the multiple segments. U.S. Pat. No. 3,956,990 issued to Rowe for Beehive Projectile discloses an anti-personnel ammunition capable of direct and indirect fire. U.S. Pat. No. 3,938,442 issued to Donadio for Serrated Supporting Keying System for a Beehive Projectile discloses a keying system for interlocking the components of a beehive type projectile by set back force generated by firing of the projectile. I have found that the art does not show a way to reliability and accurately eject objects through a rotational motion.

SUMMARY OF THE INVENTION

It is therefore an objective of the present invention to provide cylinders that are ejected from a dispenser by being controlled accurately and precisely by machined components without bunching.

It is another object to have releasing forces that act parallel to the axis of each cylinder, minimizing off-axis force components that would disturb the cylinders' natural trajectory.

It is another object to simultaneously release objects such as cylinders that are controlled by the characteristics and interaction of just two components making deployment reliable and precise.

It is yet another object to limit the motion of the deployment mechanism to engagement depth plus clearance dimension, minimizing the distance of actuation and thereby minimizing deployment time and cylinder misalignment ("tip-off" disturbance);

It is still another object to require no dunnage or packing material that could interfere with smooth cylinder motion during deployment.

To achieve the objectives of the present invention, there is provided a dispenser that uses rotation around the axis of symmetry of the dispenser to eject several cylindrical objects in any of many regular, predictable patterns. The dispenser includes a holding plate supporting a first side of an object, a nose plate supporting a second side of the object, an axle aligning the holding and nose plates, the holding plate, nose plate, and object rotating around the axle, and a firing unit when activated, releasing the holding plate along the axle away from the first side of the object and the nose plate being released away from the second side of the object, the object being released away from the axle when the holding plate and the nose plate releases away from the object. The dispenser rigidly holds the cylinders within a carrier vehicle as the vehicle accelerates to a high velocity. The dispenser is spinning about the axis of the dispenser at a high rate. Then on signal, the dispenser releases all of the cylinders simultaneously. Each one of the cylinders leaves the vehicle with the cylinder's axis parallel to that of the dispenser and at each cylinder's own tangential velocity.

A top tail plate may be placed above the dispenser plate and a bottom plate may be placed below the nose plate. A stopper plate made of honeycomb aluminum may be placed in between the top tail plate and the holding plate and another stopper plate between the bottom tail plate and the nose plate to absorb any impact from the motion of the holding plate and the nose plate. The mass of the holding plate assembly and the nose plate assembly is preferably the same.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
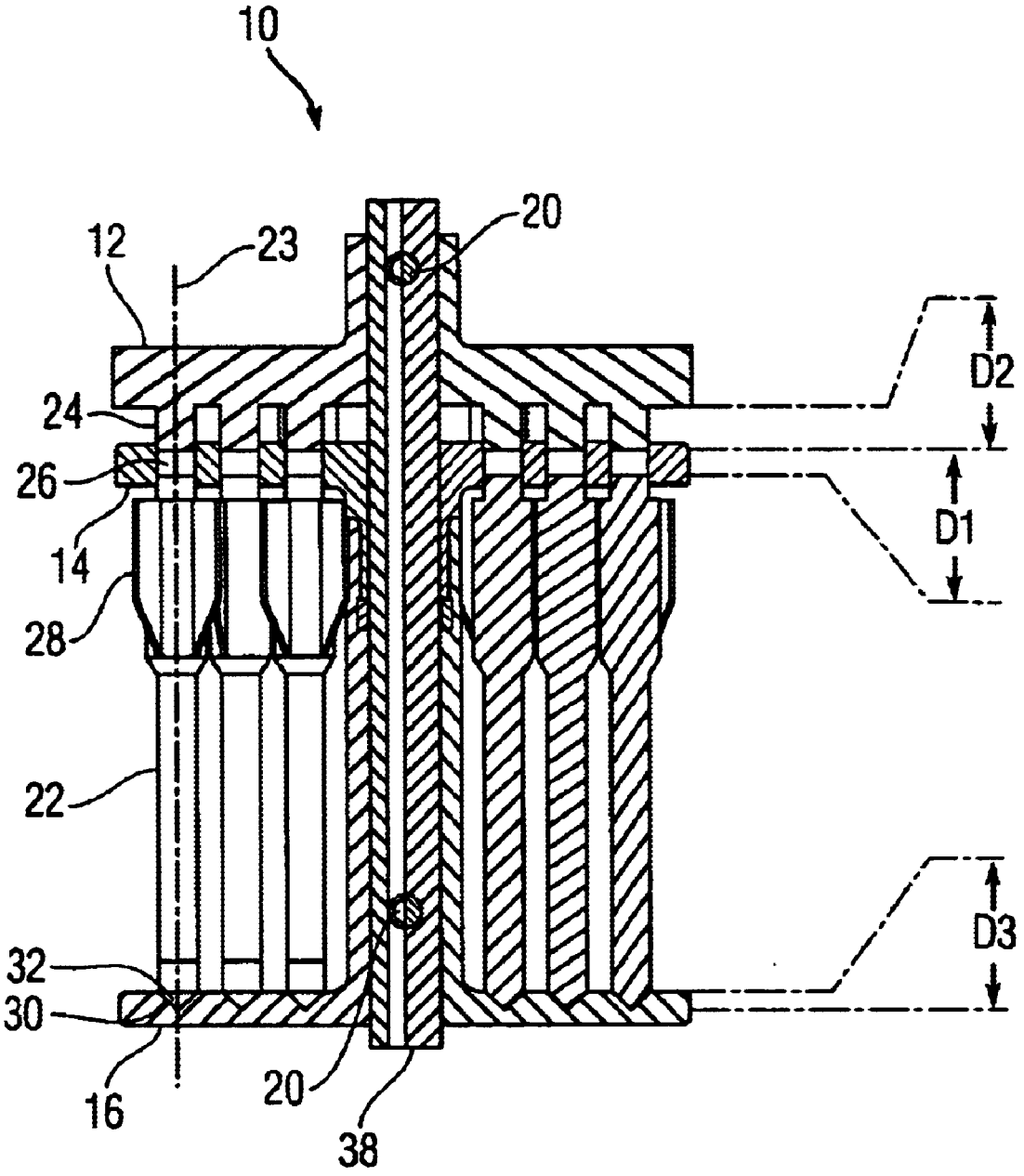
FIG. 1 is a cross sectional view of the dispenser assembly.

Turning now to the drawings, FIG. 1 illustrates an embodiment of the present invention having a dispenser 10 that uses the tangential velocity of rotation to eject patterns of cylindrical objects 22. More specifically, the dispenser 10 uses the gradient of the tangential velocity with radius from the axis of rotation to eject patterns of cylindrical objects 22. The dispenser has a tail plate 12, holding plate 14, and nose plate 16 riding on a central alignment axle 38. The tail plate 12 and the nose plate 16 are secured to the alignment axle 38. The alignment axle 38 has locking dowel pins 20. The holding plate 14 is movable between tail plate 12 and the nose plate 16 along the axle 38, but can be locked in place. Referring to FIG. 1, with the holding plate 14 locked in the closed position, holding plate 14 and nose plate 16 positively trap several cylinders 22 by counterbored holes 26 in the holding plate 14 that grip one end 28 of each cylinder 22 and form-fitting depressions 30 made to "cylinder engagement depth" $D_3$ in the nose plate 16. The form-fitting depressions 30 hold the front end tips 32 of the cylinders 22. The tail plate 12 has protrusions 24 of a length equal to the thickness of the holding plate 14 plus a release allowance (or clearance) $D_1$ that must be found according to factors such as acceleration, and vibration of the dispenser. Each protrusion in the tail plate 12 aligns with a hole 26 in the holding plate 14. The dimensions of the tail plate 12, holding plate 14, nose plate 16, and the alignment axle 38 are chosen to produce a gap $D_2$ between the protrusions 24 of the tail plate 12 and the base 28 of each cylinder 22. The gap $D_2$ must be the sum of the cylinder engagement depth and a release clearance that must be found according such factors as acceleration, vibration of the dispenser including aerodynamic buffeting.

In operation, the dispenser mounts in a vehicle that carries the dispenser to a high speed along the axis of alignment axle 38 while spinning at a rapid rate around the axis of alignment axle 38. Upon command, an actuation device (not shown) applies a force to the holding plate 14 parallel to the alignment axle 38 in the direction of the tail plate 12. The holding plate 14 drags cylinders 22 toward tail plate 12, disengaging cylinders 22 from the nose plate 16. When the motion of the holding plate 14 brings the ends 28 of the cylinders 22 into contact with the protrusions 24 in the tail plate 12, the cylinders 22 stop moving relative to the tail plate 12, while the holding plate 14 continues in the direction of the tail plate 12. Referring to FIG. 1, when the holding plate 14 contacts the tail plate 12 (the dispenser's open position), cylinders 22 are released simultaneously so that each cylinder's tangential velocity will carry them out of the confines of the rotating dispenser. Actuation force on the holding plate 14 is chosen to be large enough to keep the time of actuation short, to the point that the longitudinal axis 23 of the cylinder 22 are substantially parallel to the dispenser's axis of rotation as cylinders 22 depart from the dispenser 10. Each cylinder 22 leaves the dispenser with the axis 23 of the cylinder parallel to that of the dispenser at each cylinder's 22 own tangential velocity.

Figure 2:
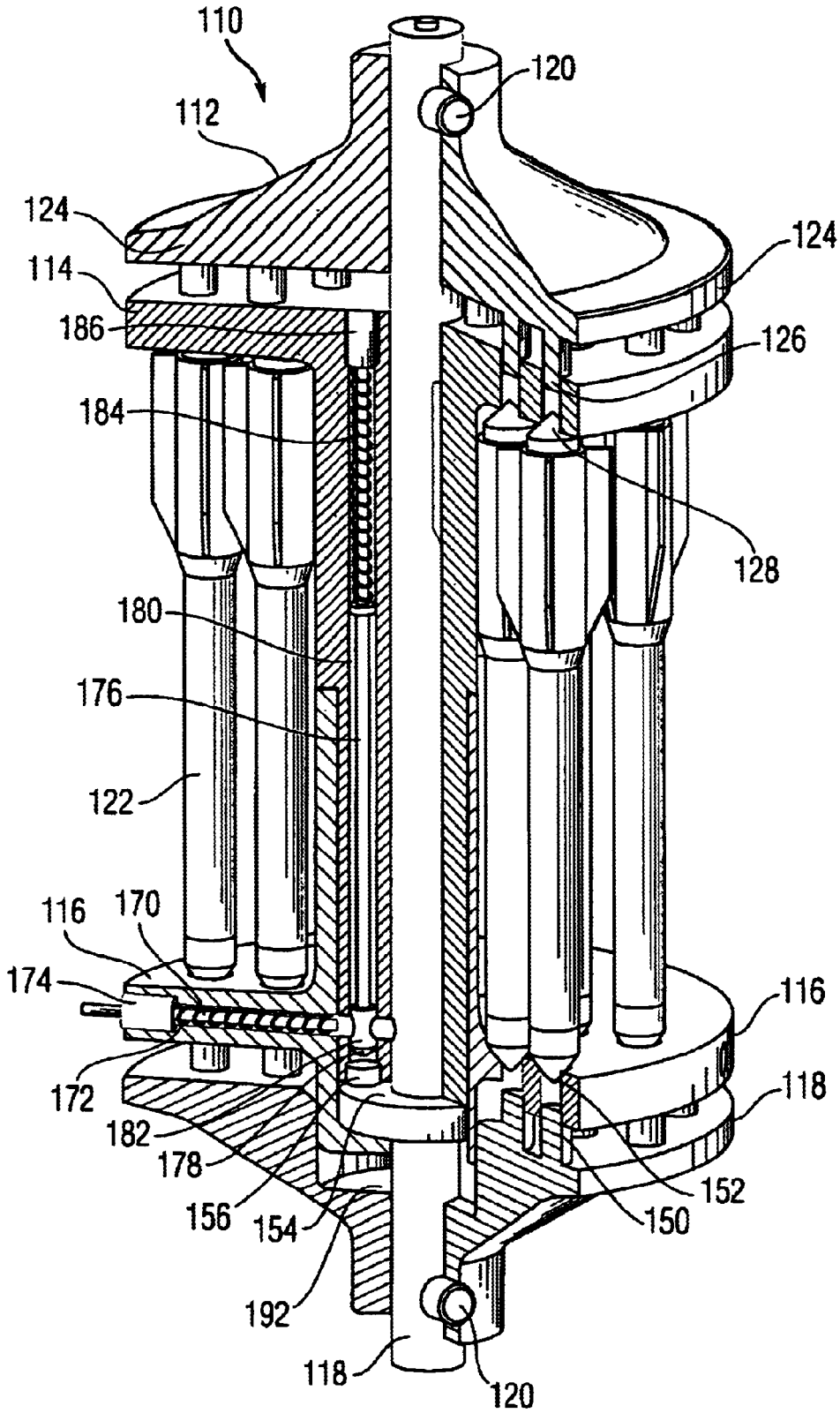
FIG. 2 is a cross sectional view of the dispenser in the closed position.
Figure 3:
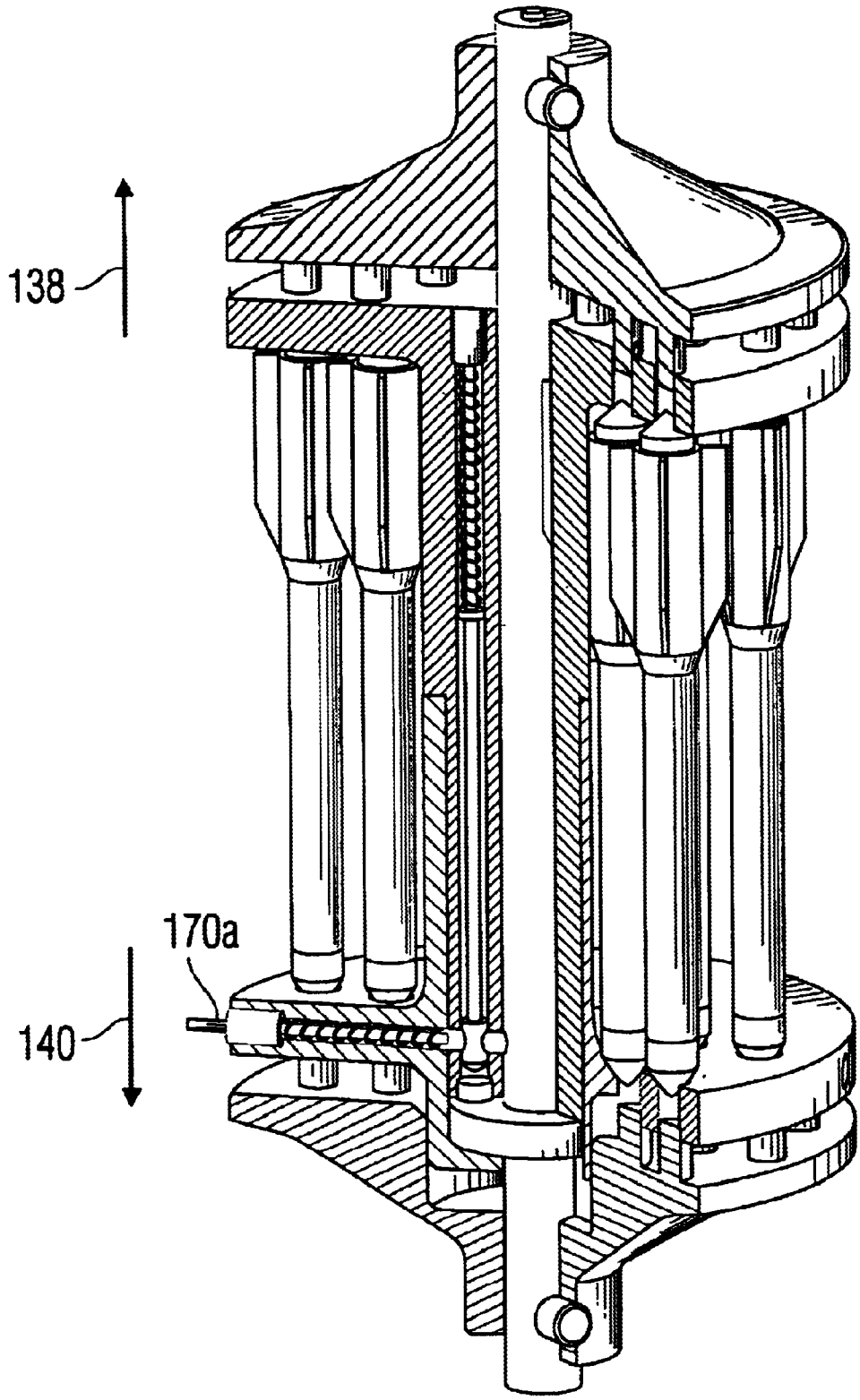
FIG. 3 is cross sectional view of the dispenser in the armed and closed positions.
Figure 4:
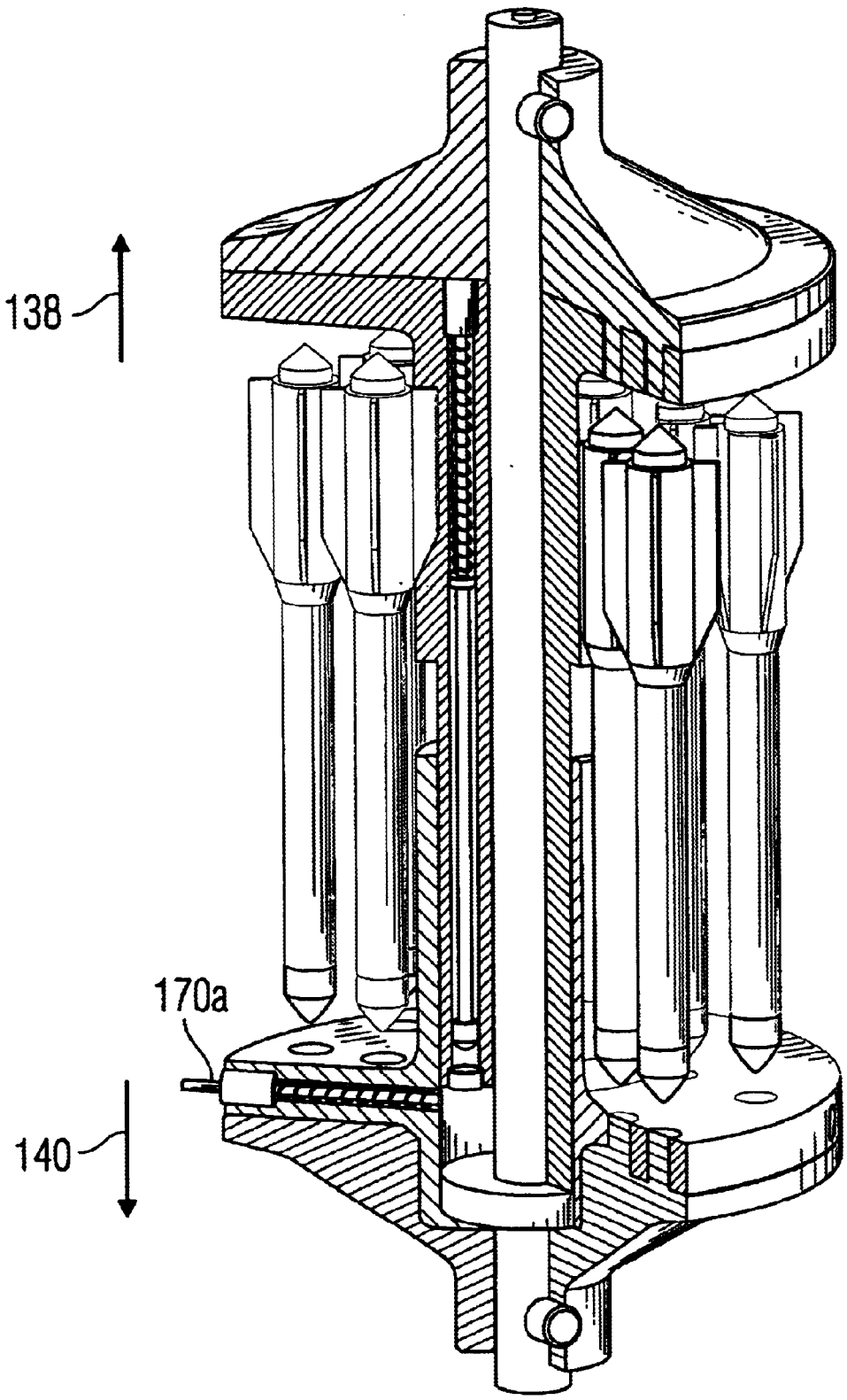
FIG. 4 is cross sectional view of the dispenser in the open position.

FIGS. 2 through 4 show another embodiment of the present invention. A bottom tail plate 118 has protrusions 152 that penetrate through counterbored holes 150 of the nose plate 116 in a fashion similar to the top tail plate 112. Each protrusion 124 in the tail plate 112 aligns with a hole 126 in the holding plate 114.

Referring to FIGS. 2 through 4, the firing mechanism is shown more clearly shown. The holding plate 114 and the nose plate 116 are held in place by the firing mechanism. The firing mechanism has a firing pin 178 parallel with the alignment axle 138. The firing pin 178 is supported and enclosed within a firing pin case 180. The firing pin 176 is separated from the top holding plate by a spring 184 and a retainer bushing 186. In the closed position as seen in FIG. 2, The firing pin 176 is held in place by a sear pin 170 penetrating through a bottom portion 178 of the firing pin 176. The sear pin 170 is perpendicular to the firing pin 176. The sear pin 170 has a sear pin retainer bushing 174 at the end away from the firing pin 176. A spring 172 circumscribes the sear pin 170. A boar rider 170a of the sear pin 170 protrudes out of the sear pin retainer bushing 174 when the dispenser 110 is in the armed and closed position as seen in FIG. 3. A gas generator 154 is located along the alignment axle 138. When the shell comes off the projectile, in the dispenser 110, a boar rider 170*a* comes out of the sear pin 170 by the spring 172. The sear pin 170 moves out of the firing pin aperture 182. The release of the sear pin 170 releases the firing pin 176 downward toward the percussion primer 156. The impact of the head 182 of the firing pin 176 on the percussion primer 156 initiates the propellant in the gas generator 154 and lowers to the bottom of cavity 192, and the percussion primer 156 along with the firing pin 176 and the firing pin case 180 are pushed upwards, compressing the spring 184. The pressure from the propellant acts to raise the holding plate 114 against the top tail plate 112, and the nose plate 116 is forced downward against the bottom tail plate 118. When the holding plate 114 and the nose plate 116 move, the cylindrical objects 122 are released from the dispenser.

As seen in FIG. 4, when in the open position, the holding plate 114 and the nose plate 116 move towards the top tail plate 112 and bottom tail plate 118, respectively, as shown by arrows 142 and 144. This motion releases the cylindrical objects or darts 122 from the dispenser 110.

Figure 5:
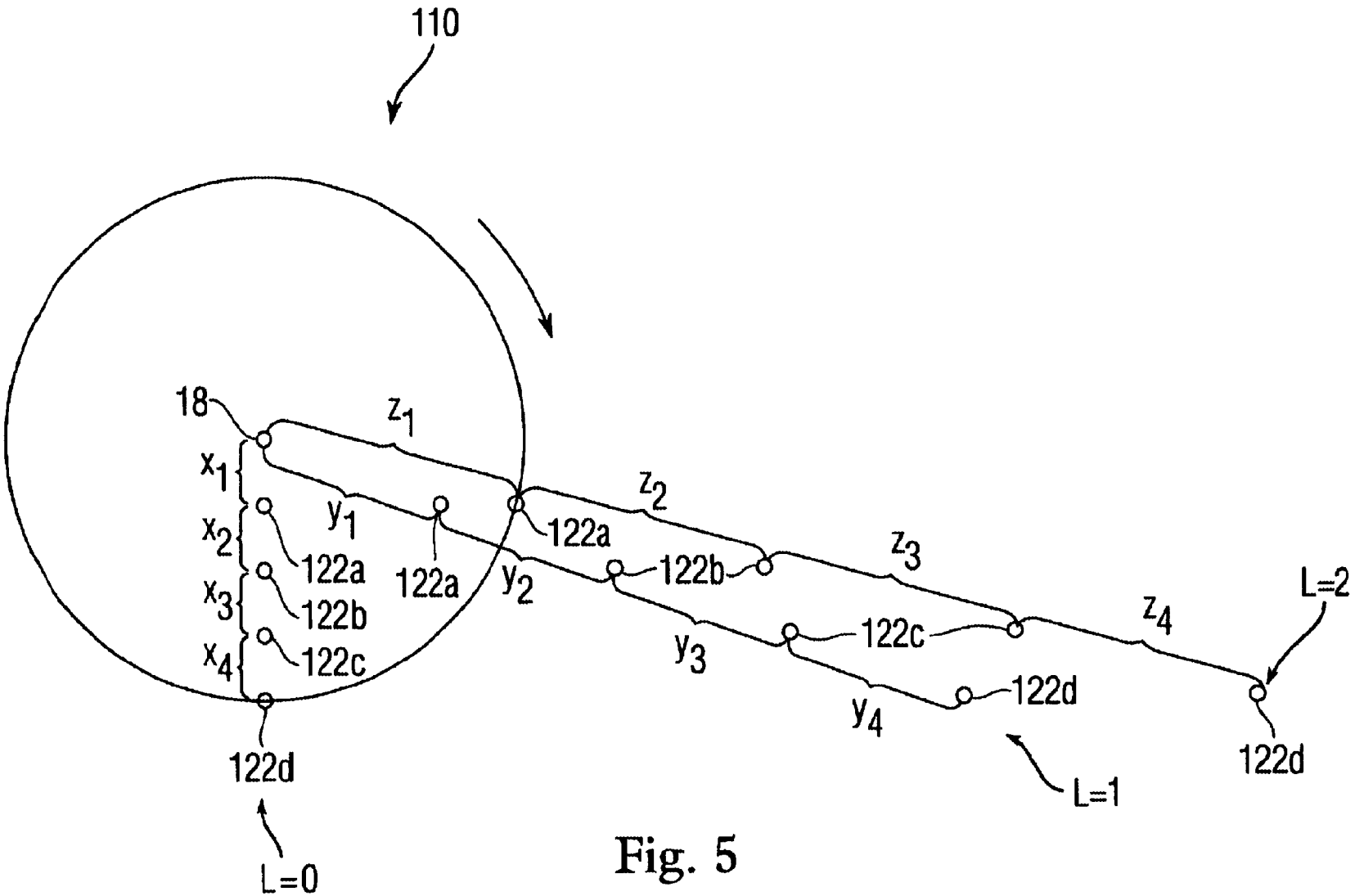
FIG. 5 shows an overhead view of the movement of cylindrical objects from the dispenser.

FIG. 5, shows the trajectory of the cylindrical objects 122. At time=0, cylindrical objects 122*a*, 122*b*, 122*c*, and 122*d* are within the dispenser 110 and the dispenser has just been positioned in the open state. The distance between the alignment axle 138 and the cylindrical object 122*a* is $x_1$ at t=0. The alignment axle 138 is located on the midpoint of the dispenser 110. The distance between 122*a* and 122*b* is $x_2$ at t=0. The distance between 122*b* and 122*c* is $x_3$ at t=0. The distance between 122*c* and 122*d* is $x_4$ at t=0.

At time=1, the cylindrical objects, 122*a*, 122*b*, 122*c*, 122*d* are being ejected from the dispenser 10. The distance between the alignment axle 138 and the cylindrical object 122*a* is $y_1$ at t=1. The distance between 122*a* and 122*b* is $y_2$ at t=1. The distance between 122*b* and 122*c* is $y_3$ at t=1. The distance between 122*c* and 122*d* is $y_4$ at t=1.

At time=2, the cylindrical objects 122*a*, 122*b*, 122*c*, 122*d* are traveling further. The distance between the alignment axle 138 and the cylindrical object 122*a* is $z_1$ at t=2. The distance between 122*a* and 122*b* is $z_2$ at t=2. The distance between 122*b* and 122*c* is $z_3$ at t=2. The distance between 122*c* and 122*d* is $z_4$ at t=2.

The following ratios hold as the cylindrical objects 122 travel from time=0 (t=0) to time=2. For example (x1/x2)=(y1/y2)=(z1/z2). Also, (x1/x4)=(y1/y4)=(z1/z4).

As the cylindrical objects 122 are moving away from the dispenser 110, the cylindrical objects 122 maintain a uniform rate of separation from each other, allowing all ratios of distances 1s between objects 122 to be the same. If for example, x1=x2=x3=x4, then y1=y2=y3=y4, and z1=z2=z3=z4.

As the cylindrical objects 122 leave the dispenser 110, they will maintain the same rotational speed as the dispenser 110. The darts (or cylindrical objects) 122 will have no acceleration once leaving the dispenser but will have an initial velocity at time equal to zero when the dispenser releases the darts 122.

Figure 6:
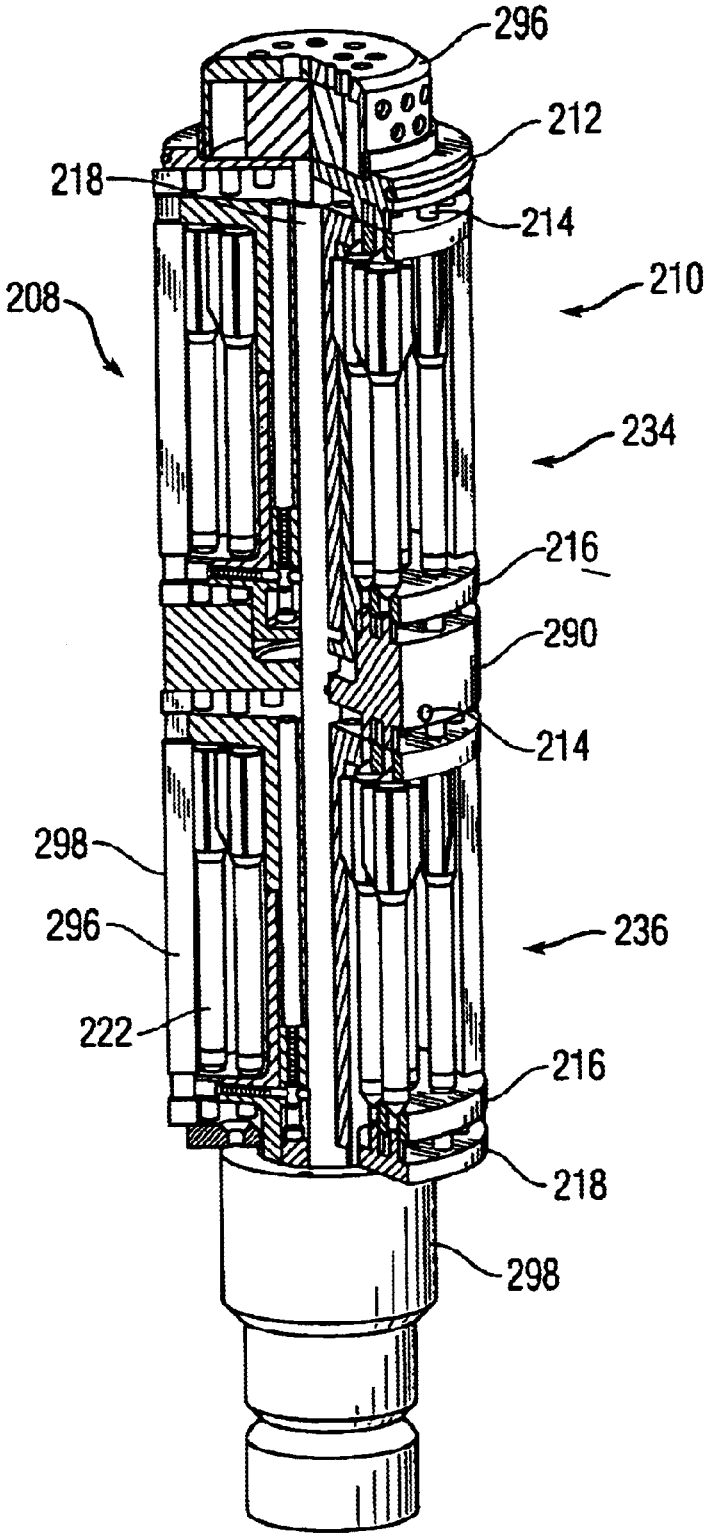
FIG. 6 is a cross sectional view of a two stage dispenser assembly.
Figure 7:
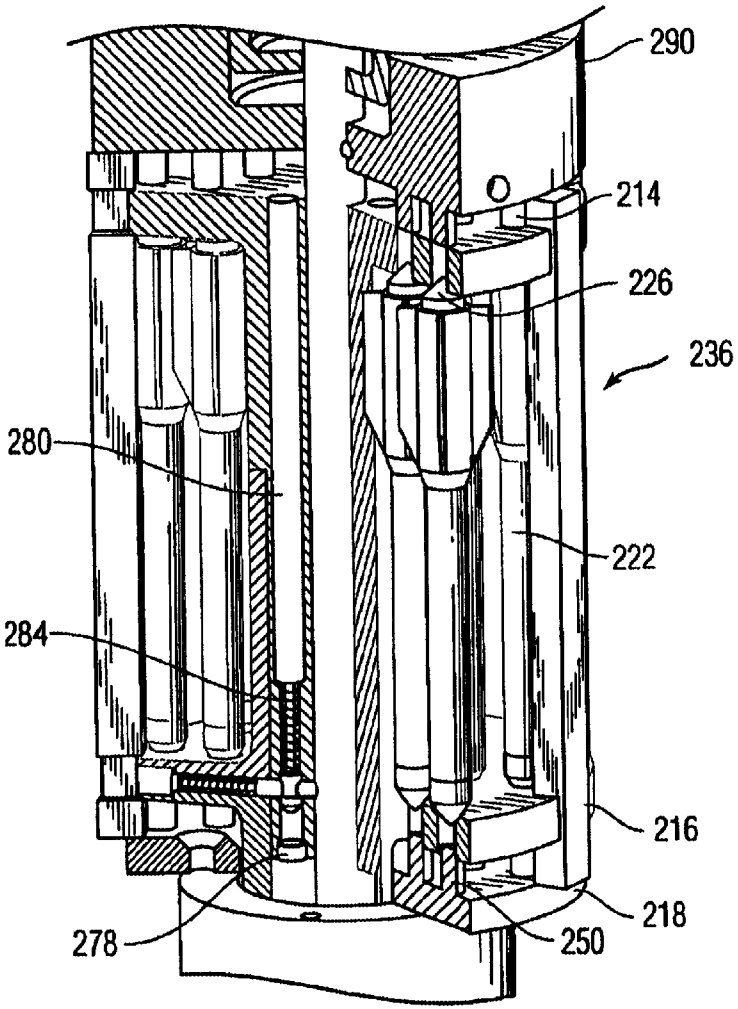
FIG. 7 is a close-up cross sectional view of one of the stages of the dispenser from FIG. 6 in the closed position.

Referring to FIG. 6, a two stage dispenser 210 is shown. The first stage 234 and the second stage 236 are located along a single alignment axle 218. The dispenser, has cylindrical objects 222 that are encased within a holding plate 214 and a nose plate 216 in stage one 234 and stage two 236. The cylindrical objects are engaged with the holes 226 of the holding plate 214 and the holes 226 of the nose plate 216. Stage one 234 has a large tail plate 290 that forms a support for the nose plate 216 for stage one 234 and the large tail plate 290 support for the holding plate 214 for stage two 236. As seen in FIG. 7, the tail plate 218 forms the support for the nose plate 216 for stage two 236.

Figure 8:
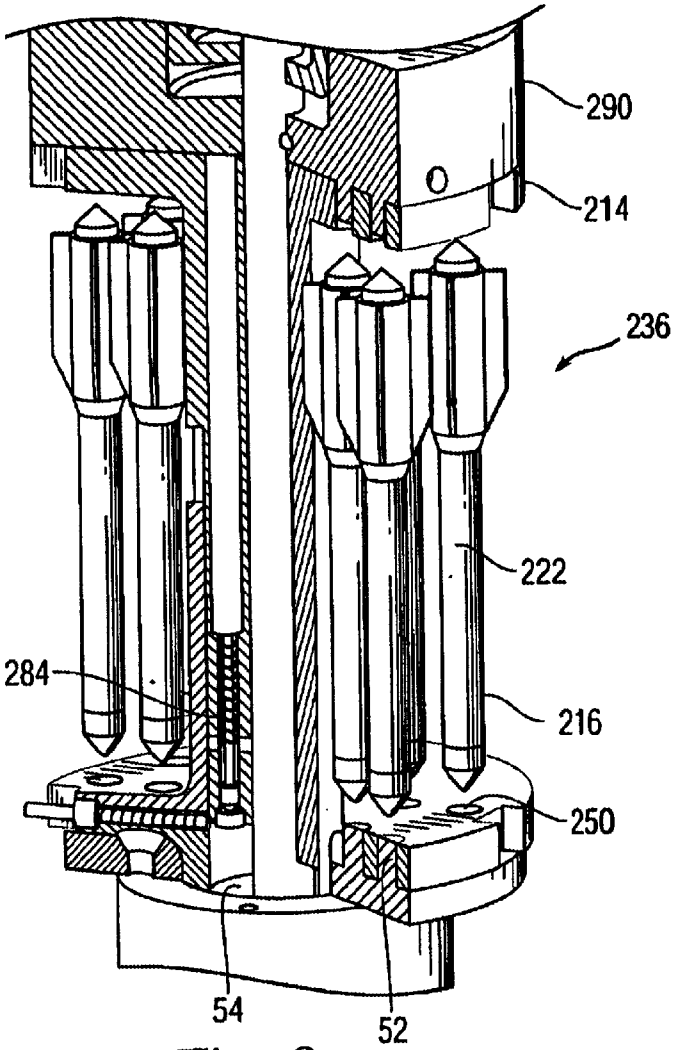
FIG. 8 is a close-up cross sectional view of one of the stages of the dispenser from FIG. 6 in the open position.

The embodiment as shown in FIGS. 6, 7 and 8 have the same operation mechanism as the embodiment as in FIGS. 2, 3, and 4. A spring 284 compresses or expands according to the motion of the firing pin 278. When the firing pin 278 activates propellants through a gas generator 254, the force from the propellants allows the movement of the tail plates 214, and nose plates 216, releasing the cylindrical objects 222 from the dispenser 210 as seen in FIG. 8.

As seen in FIG. 6, at one end of the dispenser 210, the gas generator 296 is responsible for striping the shell 298 of the projectile 208. A ballast weight 298 is connected to the other end of the dispenser 296. The ballast weight 298 is responsible for interfacing with the nose of the projectile 208 and for balancing the projectile (or vehicle) 208. The space bars 296 secure the holding plate 214 and the nose plate 216 in position until the shell 298 is released from the vehicle 208.

The objects may have forms other than a cylindrical shape such as a spherical shape or other possible shapes.

In another embodiment, as seen in FIGS.9 through 15, the dispenser 310 has a top end plate 312, a top honeycomb stopper plate 313, holding plate 314, nose plate 316, a bottom honeycomb stopper plate 317, and a bottom end plate 318, riding on a central alignment axle 338. The top honeycomb stopper plate 313 and the bottom honeycomb stopper plate 317 are made of an aluminum honeycomb material. The stopper plates 313 and 317 can also be made of any other energy absorbing material or assembly that does not have a rebound. The stopper plates 313 and 317 serve to minimize the length of the dispenser. The stopper plates 313 and 317 made of aluminum honeycomb absorb the kinetic energy by the buckling of the honeycomb walls. The honeycomb is pre-crushed to about ¼ inch to reduce the peak stopping-load. In the dispenser 310, the stopper plates 313 and 317 prevent the holding plate 314 and the nose plate 316 from slamming into end plates 312 and 318, respectively. Slamming into the end plates 312 and 318 can affect the deployment of cylinders 322 from the dispenser 310. End plates 312 and 318 are secured to alignment axle 338 with locking devices 320 such as dowel pins, setscrews, retaining rings, adhesives, or weldments. It is preferred that the holding plate assembly 364 and nose plate assembly 366 have the same mass. The holding plate assembly 364 includes the holding plate 314 and any components supported by the holding plate 314 such as the firing pin 378, the firing pin case 380, the retainer bushing for the firing pin 386, the firing pin spring 384, the detent ball 373, the percussion primer 356, and any other members supported by the holding plate 314. The nose plate assembly 366 includes the nose plate 316 and components supported by the holding plate such as the sear pin 370, boar rider for the sear pin 370a, retainer bushing for the sear pin 374, the sear pin spring 372, and any other members supported by the nose plate 316. Holding plate 314 and nose plate 316 lock together, and can move or lock in place between the top end plate 312 and the bottom end plate 318 along axle 138.

Figure 9:
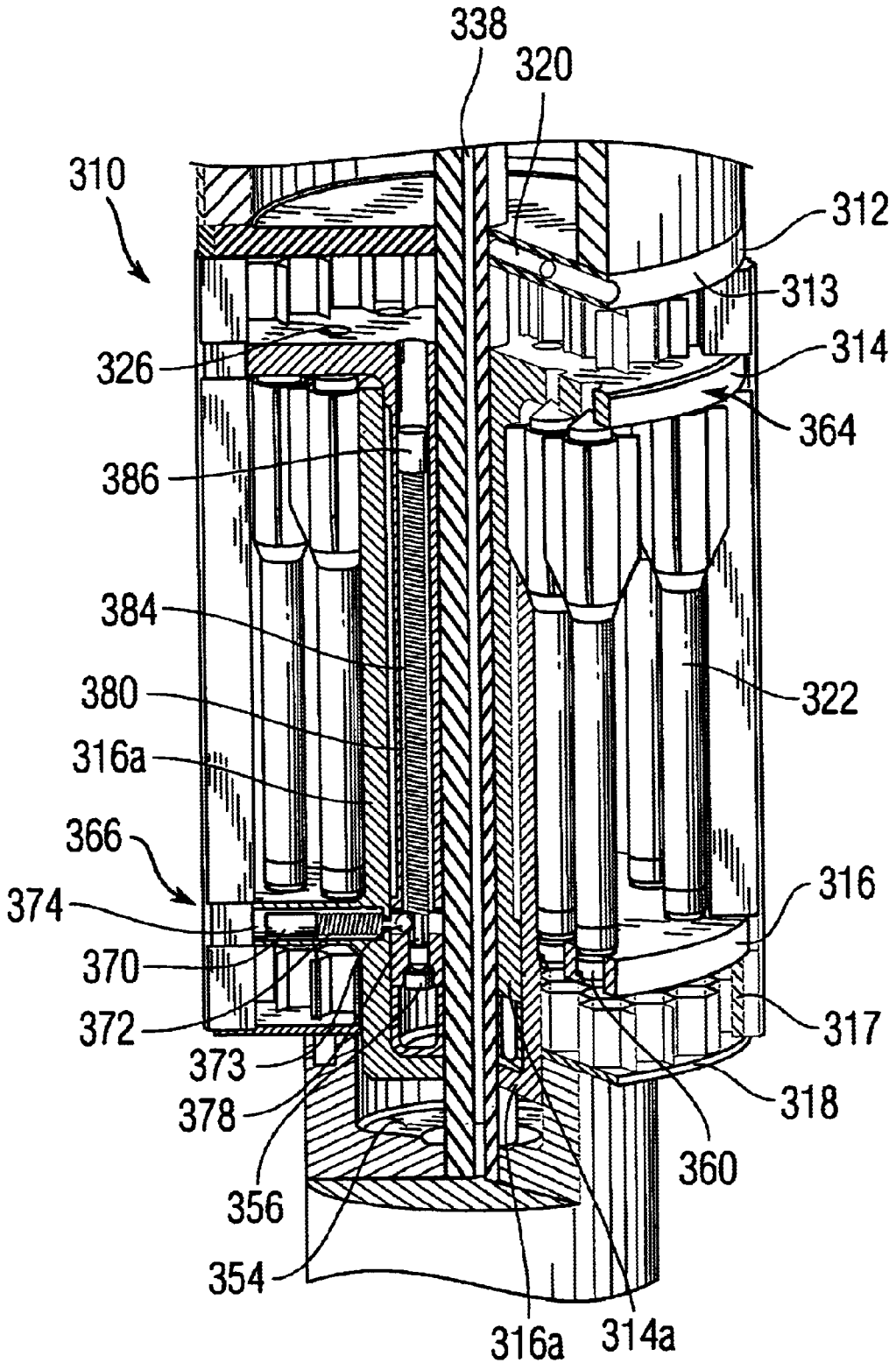
FIG. 9 is a cross sectional view of a dispenser of another embodiment in the closed position.

Holding plate 314 and nose plate 316 locked together on axle 138 in the "closed" position as seen in FIG. 9, holes 326 in holding plate 314 and holes 362 in the nose plate 316 engage several cylinders 322, positively holding the cylinders 322 between the holding plate 314 and nose plate 316. Counter-sunk hollow-lock setscrews 360 in the holding plate 314 allow adjustment of the force holding the individual cylinders 322, whose lengths may differ slightly due to fabrication tolerances. The counter-sunk hollow-lock setscrews 360 of the holding plate 314 are sized to produce a nominal engagement depth. Nose plate 316 has counter-sunk holes 362 sized to produce a cylinder engagement depth. Dimensions of the top end plate 312, a top honeycomb stopper plate 313, holding plate 314, nose plate 316, a bottom honeycomb stopper plate 317, and a bottom end plate 318, riding on a central alignment axle 338 are chosen to produce a gap between the top honeycomb stopper 313 and holding plate 314, and between nose plate 316 and the bottom honeycomb stopper 317. Each gap has a dimension at least equal to the cylinder engagement depth plus a release allowance that is found according to factors such as acceleration and vibration of the dispenser 310.

One mechanism for spreading the holding plate 314 from the nose plate 316, uses a gas generator 354, mounted at the closed end of the nose plate 316. The gas generator 354 contains several grams of propellant, such as black powder, bull's eye, etc., or a propellant gas under pressure. One or several actuation devices activate the gas generator 354. An actuation device includes a firing mechanism and an initiator.

The firing mechanism may be mechanical, electromechanical, or electrical. One mechanical firing mechanism includes the components of a hollow-lock retainer 374, sear pin 370, sear pin spring 372, detent ball 373, firing pin 378, firing spring retainer 386, and firing spring 384. The sear pin 370 in each firing mechanism acts to hold a detent ball 373 against a firing pin 378, loaded by firing spring 384 in a firing pin case 380. When the sear pin 370 is released, loads from the firing pin spring 384 (acting on the detent ball 373 through the firing pin 378) and from the sear pin spring 372, combine to release the detent ball 373 from the firing pin 378. When the firing pin 378 releases, the firing pin spring 384 accelerates the firing pin 378 until the firing pin 378 slams into a percussion primer 356. Hot gases and particles from the percussion primer initiate propellant in the gas generator 354. Pressure from the propellant acts on the flat face 314a of the holding plate 314, and the inside cylinder 316a of the nose plate 316 to spread holding plate 314 apart from nose plate 316. The holding plate 314 and the nose plate 316 preferably start to spread simultaneously. The holding plate 314 and the nose plate 316 preferably spread apart with the same magnitude of velocities but in opposite directions and the same acceleration. The motion of the holding plate 314 is preferably mirrored by the nose plate 316 at all points in time but moving in opposite directions away from each other. The uniform motion of the holding plate 314 and 316 accommodates the uniform release of the cylinders 322.

Figure 10:
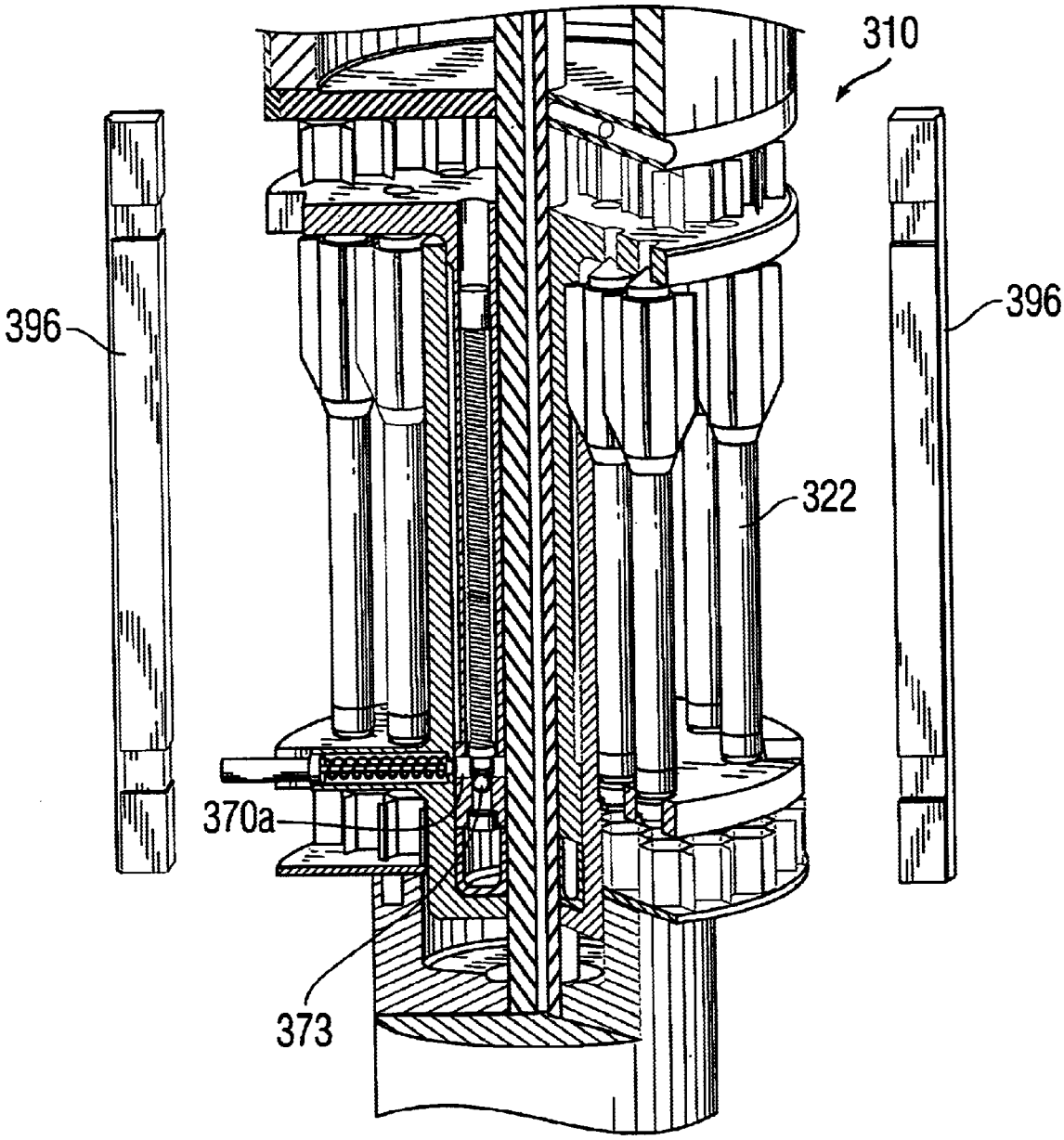
FIG. 10 is a cross sectional view of the dispenser of FIG. 9 in the armed position with space bars deployed and sear pin retracted.
Figure 11:
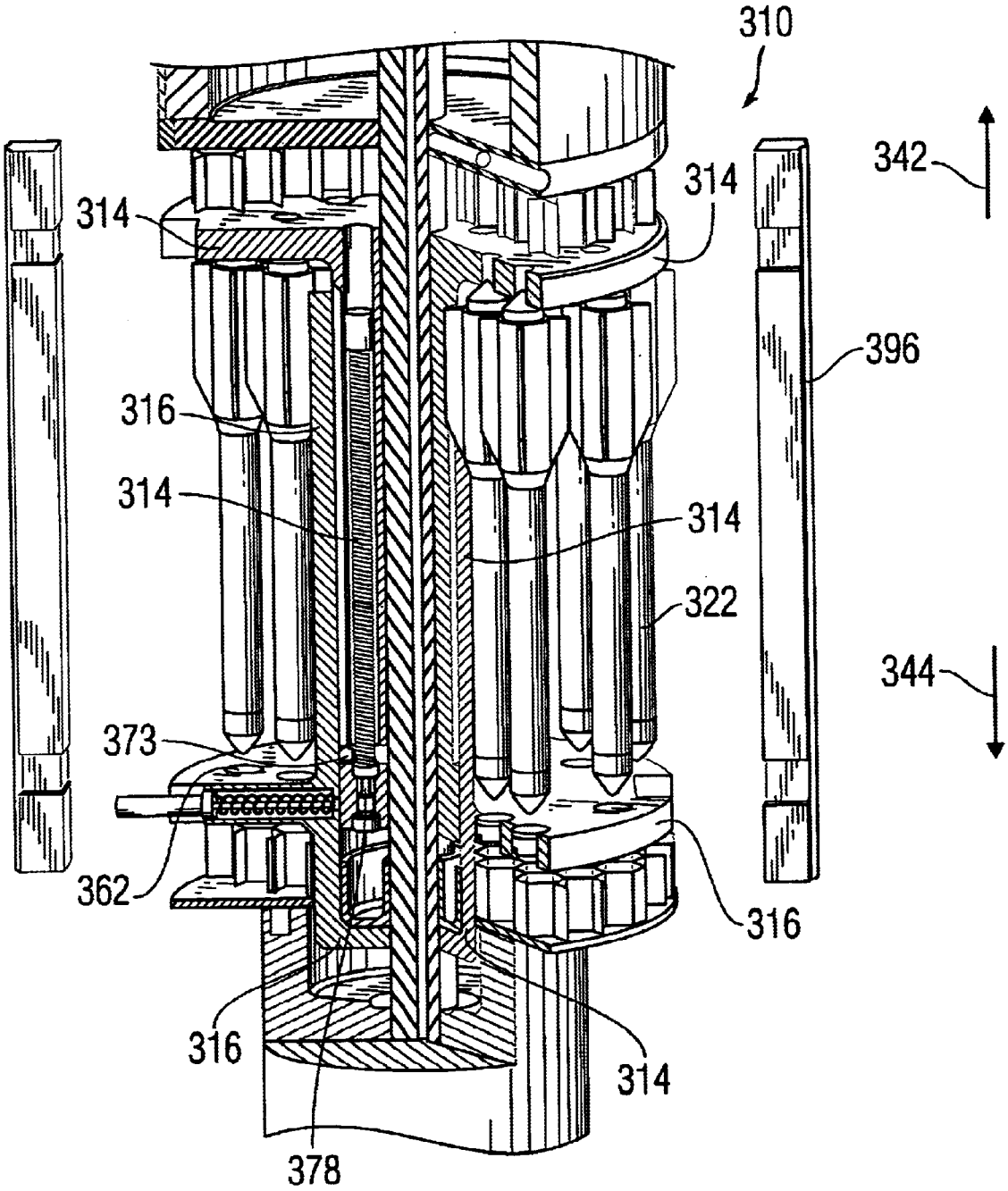
FIG. 11 is a cross sectional view of the dispenser of FIG. 10 in the open position with firing pin released and plates clear of cylinders.
Figure 12:
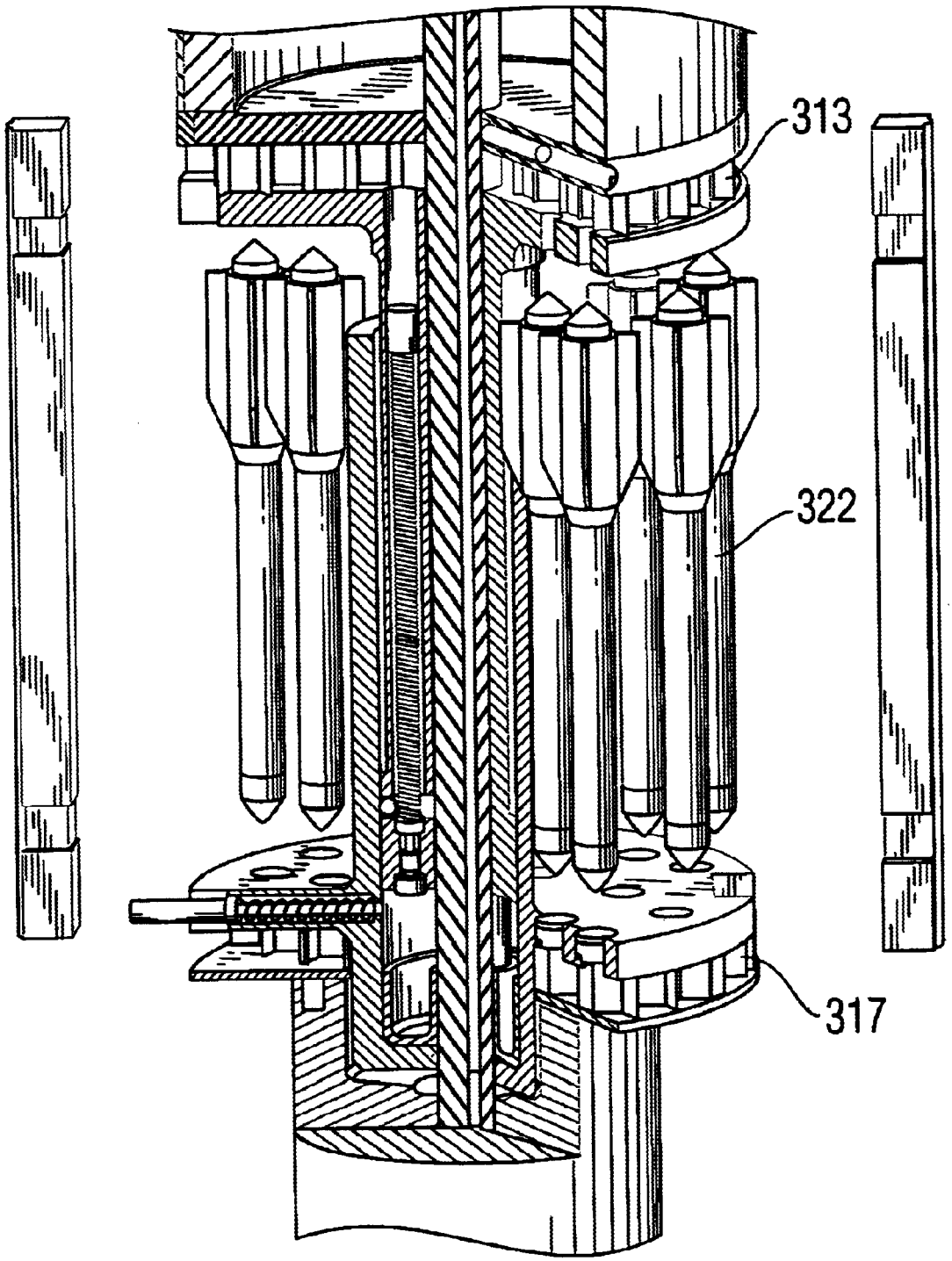
FIG. 12 is a cross sectional view of the dispenser of FIG. 11 in the open position with honeycomb stopper plates half crushed and cylinders beginning deployment.
Figure 13:
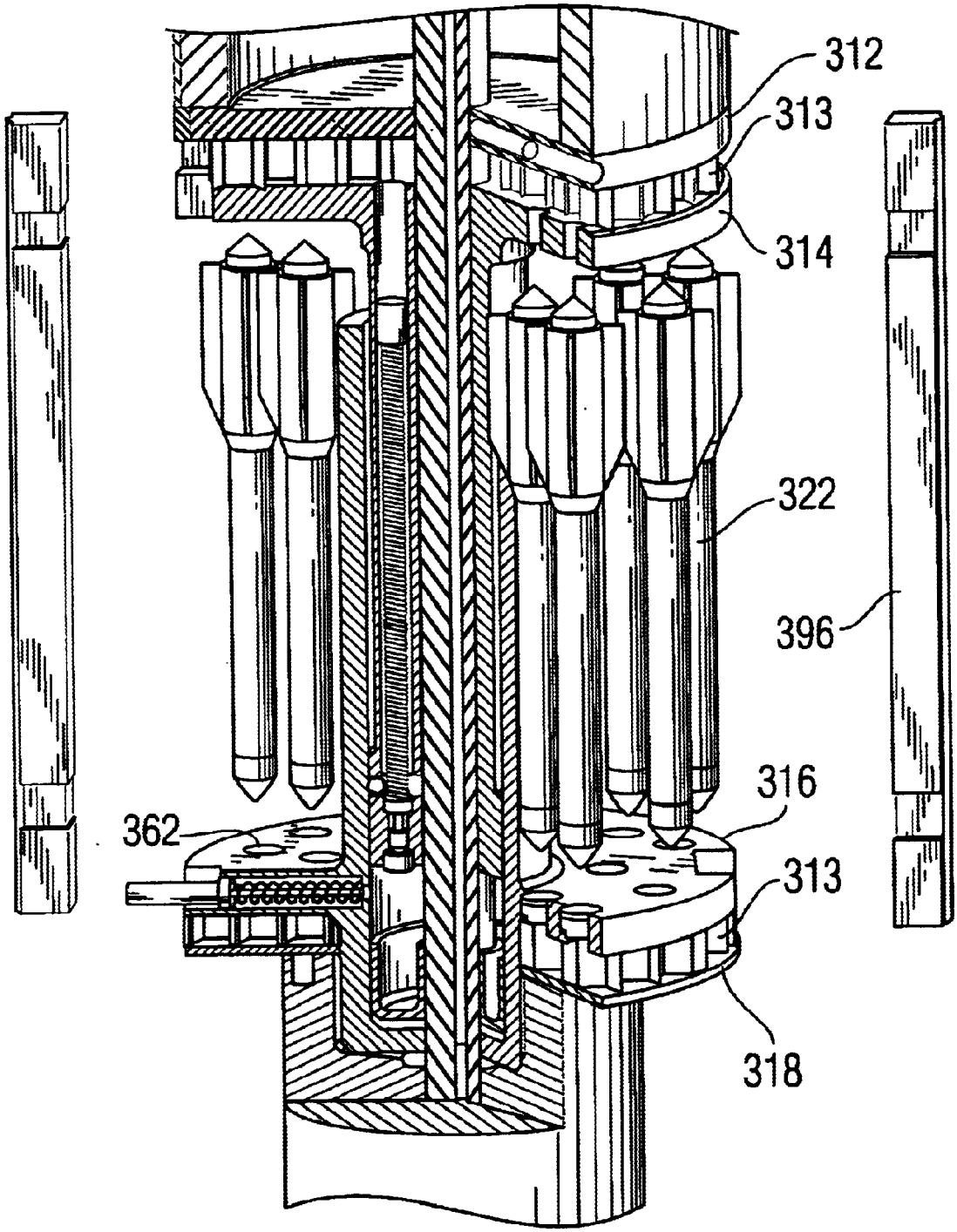
FIG. 13 is a cross sectional of view of the dispenser of FIG. 12 in the open position with honeycomb stopper plates fully crushed and cylinders continuing to deploy.
Figure 14:
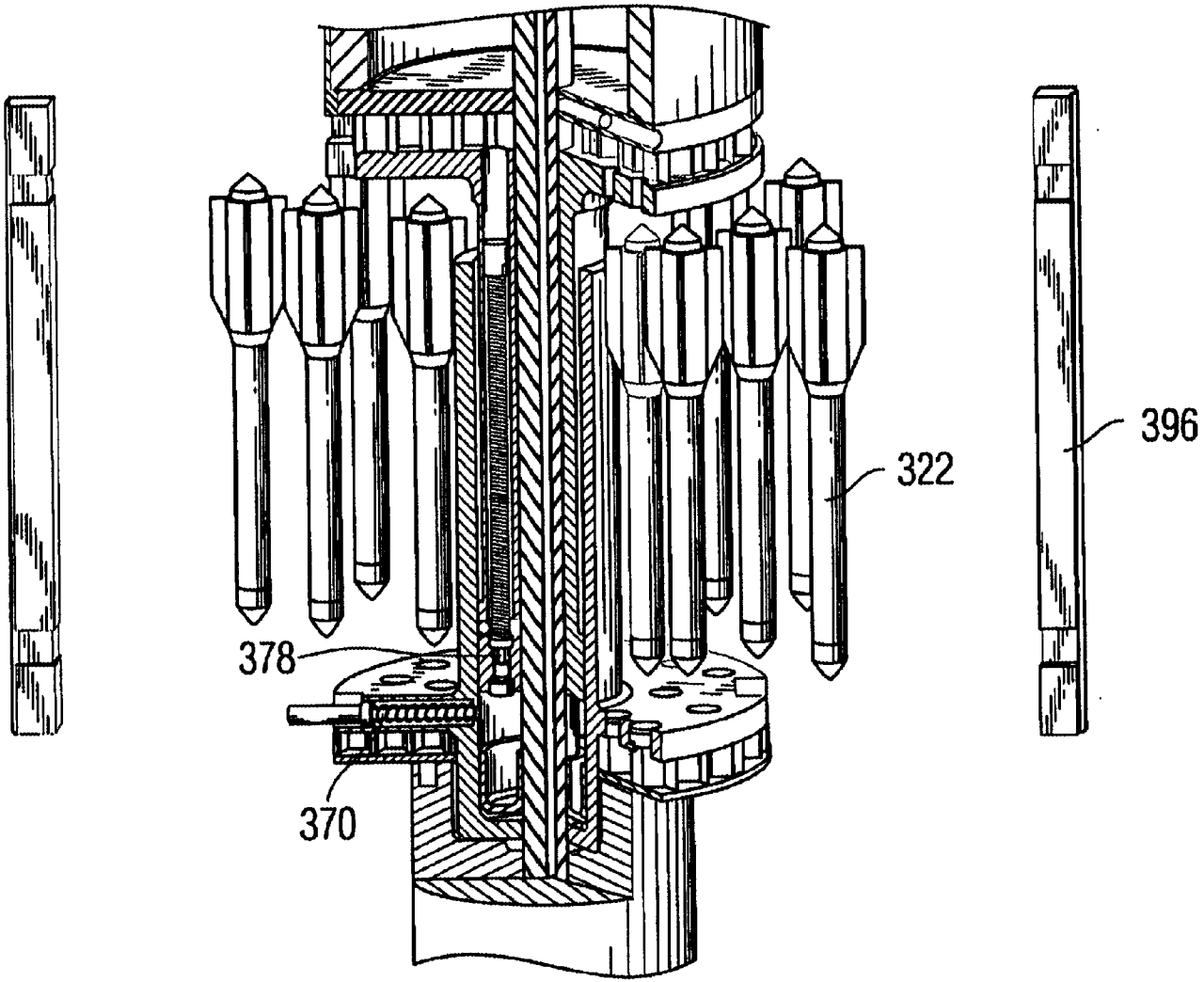
FIG. 14 is a cross sectional view of the dispenser of FIG. 13 in the open position with the cylinder patterns expanding out of the dispenser.
Figure 15:
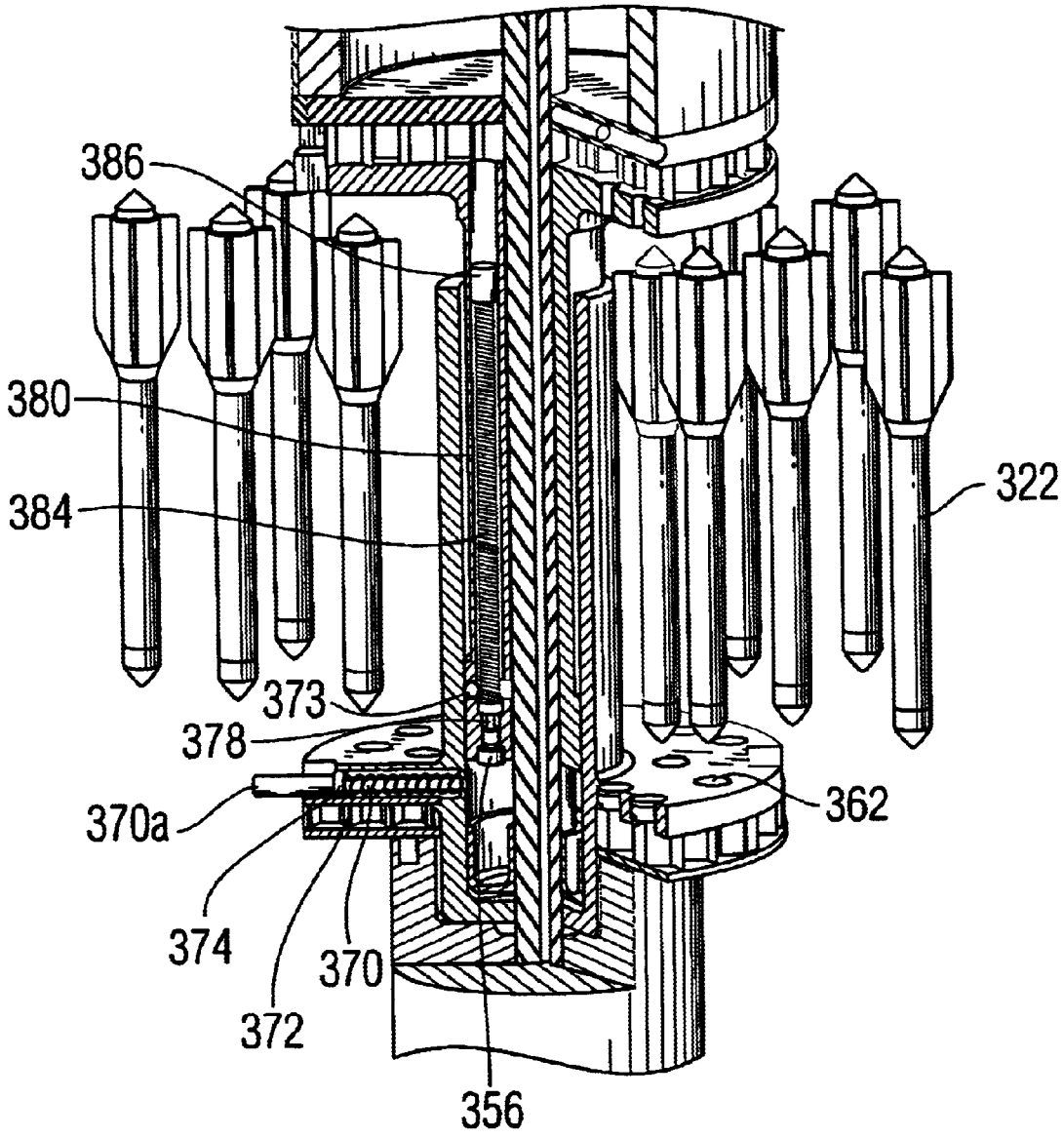
FIG. 15 is an enlarged view of the dispenser of FIG. 14.

In operation, the dispenser mounts in a vehicle that carries the dispenser 310 to a high speed along the axis of the alignment axle 338 while rotating around the axis of the alignment axle 338. The space bars 396 secure the holding plate 314 and the nose plate 316 in position until the shell of the vehicle is released. The shell for instance forms an outer cover of the vehicle and surrounds the dispenser. When the space bars 396 are released, as seen in FIG. 10, the boar rider 370*a* of the sear pin 370 protrudes in an "armed" position, ready for activation. Upon command, an actuation device applies an actuation force to the holding plate 314 and the nose plate 316. The actuation force pushes the holding plate 314 away from nose plate 316 (direction arrow 342), and the actuation force pushes the nose plate 316 away from holding plate 314 (direction arrow 344), parallel to alignment axle 338. When the mass of holding plate assembly 364 is equal to the mass of nose plate assembly 366, then the holding plate 314 and nose plate 316 move away from each other with equal and opposite accelerations and velocities relative to cylinders 322 from the dispenser 310 simultaneously so that each cylinder's longitudinal axis remains substantially parallel to the dispenser's longitudinal axis. The separation of holding plate 314 from nose plate 316 disengages cylinders 322, from the dispenser 310 simultaneously, so that each cylinder's 322 tangential velocity takes it out of the confines of the rotating dispenser 310. Actuation force is calculated to minimize the actuation time of the dispenser to the point that the orientation of cylinders' 322 longitudinal axis 322*a* remain substantially parallel to the dispenser's axis of rotation 338*a* regardless of small differences in the masses of the holding plate assembly 364 and nose plate assembly 366 that result from manufacturing tolerances. The pattern of the cylinders 322 expand uniformly at a rate determined by the angular velocity (rotation rate) of the dispenser 310. The uniform expansion of the cylinders 322 is shown in FIG. 5.

As seen above, the present invention provides cylinders that are ejected from a dispenser by being controlled accurately and precisely by machined components without bunching. The releasing forces act parallel to the axis of each cylinder, minimizing off-axis force components that would disturb the cylinders' natural trajectory. The dispenser simultaneously releases objects such as cylinders that are controlled by the characteristics and interaction of just two components making deployment reliable and precise. The present invention limits the motion of the deployment mechanism to engagement depth plus clearance dimension, minimizing the distance of actuation and thereby minimizing deployment time and cylinder misalignment. There is also no requirement for dunnage or packing material that could interfere with smooth cylinder motion during deployment.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. An apparatus, comprising:

a first plate supporting a first side of an object;

a second plate supporting a second side of said object;

an axle aligning said first and second plates, said first plate, said second plate, and said object rotating around said axle; and a firing unit when activated, releasing said first plate along said axle away from said first side of said object and said second plate being released away from said second side of said object, said object being released away from said axle when said first plate and said second plate being released away from said object.

2. The apparatus of claim 1, with said second plate being released away from said second side of said object at approximately the same time as said first plate is released from said first side of said object.

3. The apparatus of claim 1, further comprising a third plate being a predetermined distance above said first plate, said third plate preventing further movement of said first plate when said first plate is released.

4. The apparatus of claim 3, further comprising a fourth plate being a predetermined distance below said second plate, said fourth plate preventing further movement of said second plate when said second plate is released.

5. The apparatus of claim 4, further comprising a fifth plate disposed between said first plate and said third plate, said fifth plate comprising of an impact absorbing material absorbing the impact of said first plate when said first plate is released towards said third plate.

6. The apparatus of claim 5, with said fifth plate being made of honeycomb aluminum to absorb the impact of said first plate against said fifth plate.

7. The apparatus of claim 6, further comprising a sixth plate disposed between said second plate and said fourth plate, said sixth plate comprising an impact absorbing material absorbing the impact of said second plate when said second plate is released towards said fourth plate.

8. The apparatus of claim 7, with said sixth plate being made of honeycomb aluminum to absorb the impact of said second plate against said sixth plate.

9. The apparatus of claim 8, further comprising a predetermined distance between said fifth plate and said first plate and said sixth plate and said second plate being approximately equal to an engagement depth of said object and predetermined release allowance, the engagement depth being the sum of the distances the object is engaged with said first plate and said second plate.

10. The apparatus of claim 9, with said second plate having a hole engaging said object in position on one side of said plate, said second plate on a second side receiving a protrusion of said fourth plate, said protrusion of said fourth plate pushing said object away from said second plate when said second plate is released.

11. The apparatus of claim 1, with said object being cylindrically shaped and positioned approximately parallel with said axle.

12. The apparatus of claim 1, with said firing unit comprising:

a firing pin; and a sear pin, said sear pin releasing said firing pin, said firing pin when contacting a percussion primer activating the motion of said first plate and said second plate away from each other.

13. The apparatus of claim 12, further comprising a shell surrounding said first and second plate, said sear pin releases said firing pin after said shell is released from said first and second plate.

14. The apparatus of claim 1, with a first plate assembly comprising of said first plate having approximately the same mass as a second plate assembly comprising of said second plate.

15. The apparatus of claim 14, wherein said first plate assembly fully supports said firing unit.

16. The apparatus of claim 15, with said first plate assembly further comprising:

a firing pin accommodating an activation of said firing unit;

a firing pin case supporting said firing pin;

a retainer bushing supporting said firing pin and said firing pin case;

a firing pin spring providing a resilient force to said firing pin;

a detent ball being held against said firing pin loaded by said firing spring in said firing pin case; and a percussion primer receiving an impact from a firing pin activating a force against said first and said second plates.

17. The apparatus of claim 16, with said second plate assembly further comprising:

a sear pin;

a sear pin spring providing a force to release a detent ball from a firing pin; and a retainer bushing supporting said sear pin.

18. The apparatus of claim 17, with said second plate assembly further comprising all components supported by said second plate.

19. The apparatus of claim 1, with said first plate and said second plate rigidly holding said object.

20. The apparatus of claim 1, with said first plate and said second plate each having an adjustable securing unit accommodating a variance in a length of said object, said adjustable securing units accommodating said first plate and said second plate to rigidly hold said object.

21. The apparatus of claim 1, with said object having a longitudinal axis substantially parallel with the axis of rotation of said object when said object is being released away from said axle and when said object is engaged with said first and second plates.

22. A method, comprising the steps of:

securing a plurality of objects between a first plate and second plate;

rotating said first plate and second plate around an axis; and releasing a first plate and second plate away from each other to release said objects away from said first and second plates.

23. The method of claim 22, with said first plate and second plate being released at approximately the same time from each other.

24. The method of claim 22, with a force moving said first plate being approximately the same as a force moving said second plate.

25. The method of claim 22, with a mass of said first plate and all components supported by said first plate being approximately equal to a mass of said second plate and all components supported by said second plate.

26. The method of claim 22, with said first plate being approximately parallel with said second plate.

27. The method of claim 22, with said plurality of objects having a cylindrical shape.

28. The method of claim 22, with said step of releasing said first and second plates being activated by firing unit disposed within said first or second plates.

29. The method of claim 22, with said objects rotating synchronously with said first and second plate.

30. The method of claim 22, further comprising the step of stopping motion of said first and second plate by an energy absorbing material or assembly having no rebound.

31. The method of claim 30, with the energy absorbing material or assembly comprising of aluminum honeycomb.

* * * * *